United States Patent [19]

McCracken

[11] Patent Number: 4,996,770

[45] Date of Patent: Mar. 5, 1991

[54] METHOD OF ASSEMBLING A CONCRETE FORM BRACE

[75] Inventor: L. Scott McCracken, Des Moines, Iowa

[73] Assignee: Economy Forms Corporation, Des Moines, Iowa

[21] Appl. No.: 461,223

[22] Filed: Jan. 5, 1990

[51] Int. Cl.[5] ..... B23P 17/00

[52] U.S. Cl. ..... 29/897.34; 29/897.3; 29/462; 29/525.1; 249/219.1; 249/3; 248/357

[58] Field of Search ..... 29/525.1, 462, 464, 29/466, 897.34, 897.31, 897.312, 897.35; 249/208, 219.1, 3, 7; 52/639, 643, 655, 699, 721; 403/232.1, 262, 403; 248/357

[56] References Cited

U.S. PATENT DOCUMENTS 1,470,673 10/1923 Ambursen ..... 248/357

2,768,434 10/1956 Taylor ..... 29/525.1

*Primary Examiner*—P. W. Echols

*Assistant Examiner*—David P. Bryant

*Attorney, Agent, or Firm*—Kent A. Herink; Brian J. Laurenzo

[57] ABSTRACT

A method for bracing a concrete form assembly by the interconnection of a first beam member and a second beam member by an inclined beam member. Each beam member is of a generally rectangular shape in transverse cross section and includes a pair of end plates. An adaptor unit of a right isosceles triangular shape in side elevation is used to connect the inclined beam to the first and the second beam. The hypotenuse section of a first adaptor unit is mounted on the first beam and the hypotenuse section of a second adaptor unit is mounted on the second beam. The locations of attachment are selected such that the distance between oppositely facing side sections of the adaptor units is equal to the length of the inclined beam member, which is inserted therebetween. Each end plate of the inclined beam member is bolted to the adjacent side section of an adaptor.

7 Claims, 2 Drawing Sheets

FIG. 2
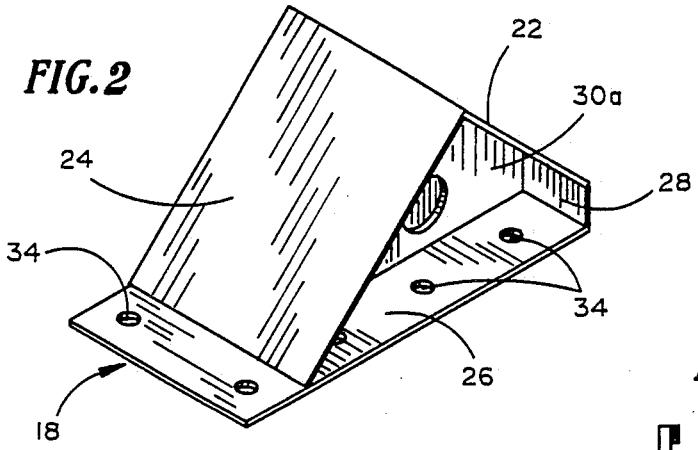
FIG. 1
FIG. 3
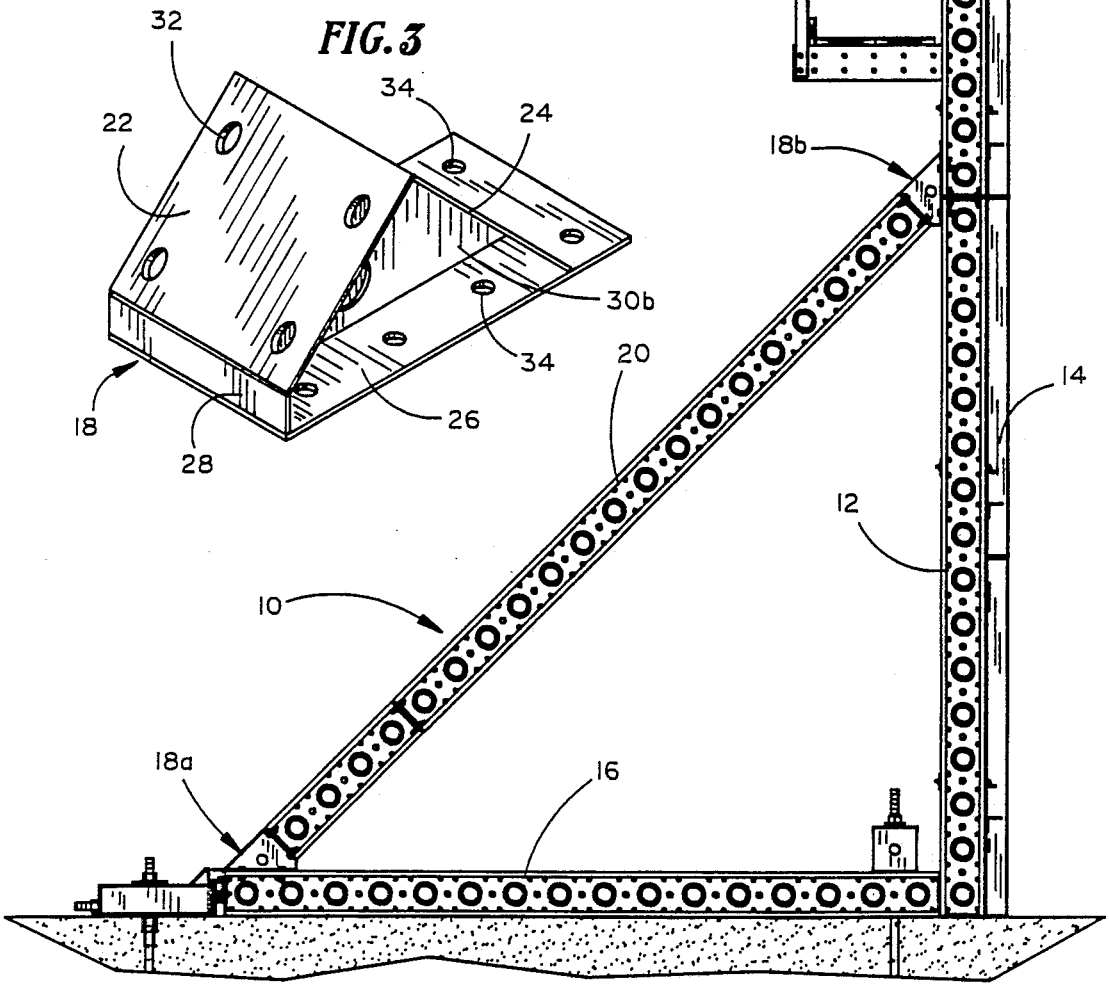

METHOD OF ASSEMBLING A CONCRETE FORM BRACE

BACKGROUND OF THE INVENTION

The present invention relates generally to concrete form systems and brace structures therefor and, more specifically, to a method for bracing an upright elongated concrete form assembly for a wall structure.

Concrete form systems are well known and widely used in the construction of diverse concrete structures. Certain of these systems make use of supporting members, such as beams, each of which is generally rectangular in cross section and provided with terminal end plates. The beam members are used as upright and horizontal structural beams, inclined bracing beams, columns, shores, or walers, and the like. When used as an inclined brace or prop, known systems make use of an adjustable length jack that extends between adjacent beams and is secured by bolts to the facing end plates by a rod. All of the forces acting on the beam members are, accordingly, borne by the rod and its connections to other parts of the form assembly.

The present invention provides a method for interconnecting a brace or prop beam member to other beam members of a beam structure by the use of a triangular shaped adaptor attached to the end plates at each end of the inclined beam member and releasably secured over a broad surface area to upright and horizontal beam members of the beam structure.

SUMMARY OF THE INVENTION

The invention consists of a method for bracing a metal concrete form assembly by a beam structure wherein an inclined brace or prop beam member is interconnected with an upright beam member and a horizontal beam member. Each beam member is of a generally rectangular shape in transverse cross section having terminal end plates. A right isosceles triangular shaped adaptor has a first side thereof secured to each end plate of the inclined beam member. The inclined beam member is of a length to place the hypotenuse side of one of the triangular adaptors in full bearing engagement with the inwardly facing side of the upright beam member and the hypotenuse side of the other triangular adaptor in full bearing engagement with the upper surface of the horizontal beam member. Nut and bolt assemblies are inserted in aligned openings formed in the beam members and adaptors to releasably secure together the beam members of the beam structure and form assembly.

BRIEF DESCRIPTION OF THE DRAWINGS

FIG. 1 is an elevational view of a metal concrete wall form in assembly relation with a beam structure that includes an upright beam, a ground-supported horizontal beam, and an inclined brace beam;

FIG. 2 is a perspective view of the plate side of a triangular shaped adaptor that forms a part of the brace structure;

FIG. 3 is a perspective view of a perforated side of the adaptor of FIG. 2;

DETAILED DESCRIPTION OF A PREFERRED EMBODIMENT

Illustrated in FIG. 1, generally at 10, is a metal concrete form assembly including a beam structure which is of a generally triangular shape in end elevation and includes an upright beam 12 to one side of which is attached a plurality of interconnected concrete forms that make up a wall form 14 against which concrete will be poured and cured to form a wall structure. Extended to the other side at the lower end portion of the upright beam is a ground-supported horizontal beam 16. One of a pair of triangular shaped adaptors 18*a* and 18*b* is bolted to each end of an inclined brace beam 20. The triangular adaptor 18*a* is also secured to the horizontal beam 16 and the triangular adaptor 18*b* is also secured to the upright beam 12 whereby the inclined brace beam 20 extends between and interconnects the horizontal beam 16 and the upright beam 12 to assist in maintaining the desired position and orientation of the wall form 14.

Figure 4:
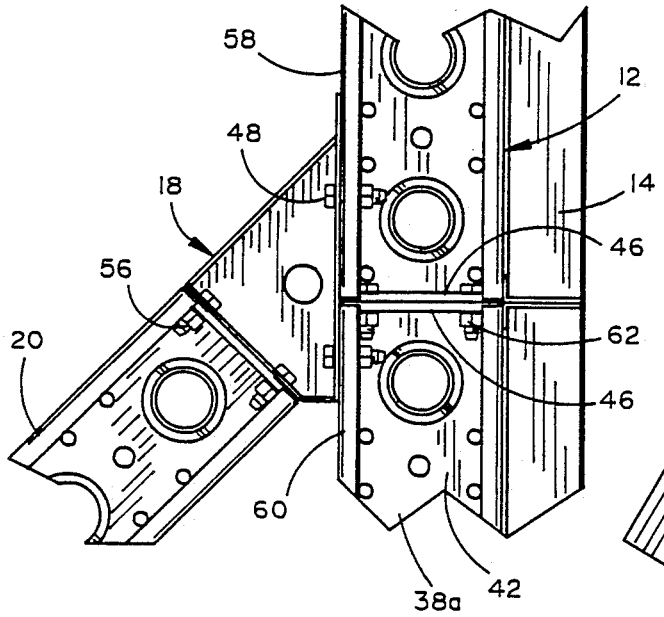
FIG. 4 is a detail elevational view of the adaptor connected between the inclined beam and the upright beam of the beam structure.

A triangular adaptor 18*a* or 18*b* are similar in construction so only 18*a* is described in detail with like numbers being applied to corresponding parts. The adaptor 18 is essentially of a right isosceles triangular shape in side elevation including a foreshortened first side section 22, a second side section 24 perpendicular thereto, and an extended hypotenuse side section 26. (FIGS. 3 and 4). The foreshortened first side 22 is connected to the hypotenuse side 24 by a short side wall 28. A pair of spaced-apart stiffening ribs 30*a* and 30*b* for strengthening the triangular adaptor 18, extend between and are secured to the inner surfaces of the sides 22, 24, 26 and 28.

The first or perforated side 22 includes four openings 32. Two rows of four openings 34 are formed in the hypotenuse side 26 along the longitudinal edges thereof and outwardly from the stiffening ribs 30*a* and 30*b*.

Figure 6:
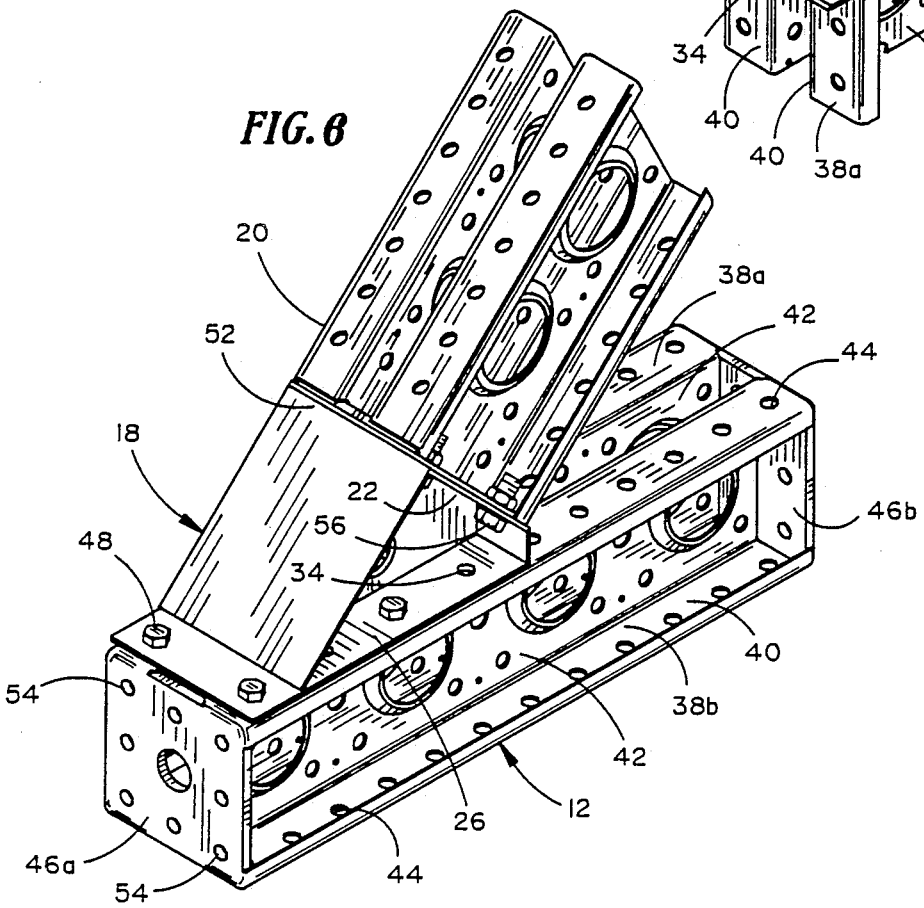
FIG. 6 is a detail perspective view showing the adaptor connected between the inclined beam and the horizontal beam of the beam structure.

The beam members 12, 16 and 20 are similar in construction so only beam member 12 is described in detail with like numbers being applied to corresponding parts. The beam member 12 is shown in FIG. 6 releasably attached to the hypotenuse side 26 of a triangular adaptor 18. The beam member 12 includes a pair of channel members 38*a* and 38*b* arranged in a back-to-back, spaced relation. Each channel member 38 is formed of a pair of transversely opposite leg sections 40 having inturned terminal edges and interconnected by a web section 42. The pair of spaced apart channel members 38*a* and 38*b* are interconnected by an end plate 46 secured to each of the terminal ends of the pair of channel members 38*a* and 38*b*.

A plurality of openings 44 are spaced longitudinally along each of the leg sections 40 of the channel members 38. To attach the adaptor 18 to the beam member 12, the openings 34 (FIGS. 2 and 3) are aligned with selected openings 44 of the legs sections 40 on one side of the beam member 12. Nut and bolt assemblies 48 (FIG. 6) are inserted in the aligned openings and tightened. To attach a second beam member 20 at a 45° angle to the first beam member 12, one of its end plates 52 is positioned in contact relation with the first side 22 of the adaptor 18. The end plate 52, corresponding to end plates 46a and 46b, has at least four openings, illustrated by end plate 46a in FIG. 6 at numeral 54, near the corners of the end plate 52 that are aligned with the openings 32 of the first side 22. Nut and bolt assemblies 56 are inserted through the aligned openings and tightened.

Figure 5:
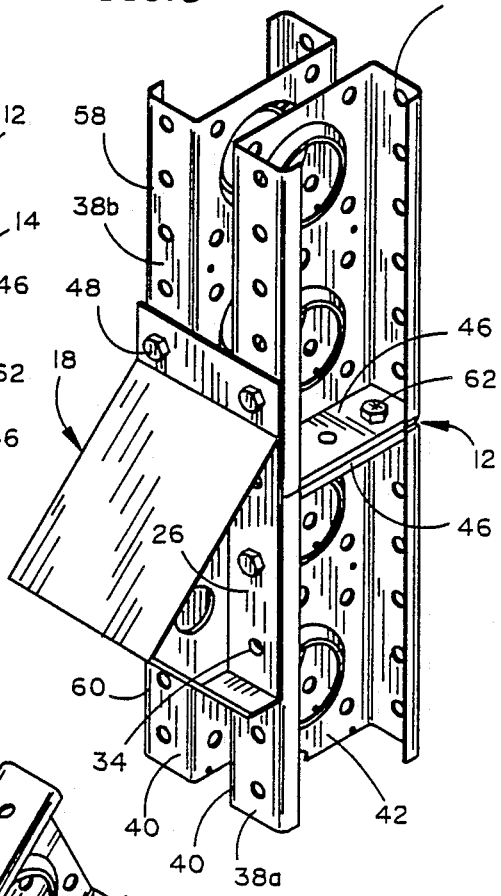
FIG. 5 is a detail perspective view showing the adaptor of FIG. 4 mounted on the upright beam of the beam structure.

The adaptor 18 can also be used wherein the hypotenuse side 26 is attached, as illustrated in FIGS. 4 and 5, to a beam at the junction between adjacent and interconnected beam members 58 and 60. In the figures, the beam sections 58 and 60 form part of an upright beam 12 of the form assembly 10 (FIG. 1). Adjacent end plates of the beam sections 58 and 60 are connected together by a plurality of nut and bolt assemblies 62. Attachment of the hypotenuse side 26 of the adaptor 18 to a side of the beam 12 and of an inclined interconnecting beam member 20 are accomplished by alignment of corresponding openings and use of nut and bolt assemblies as described previously.

The adaptor can, of course, also be used as illustrated if the beam members comprised part of a horizontal beam, the particular orientation of each of the interconnected beams being immaterial. The adaptor 18 is useful in the bracing of an upright beam by interconnection to a ground-supported horizontal beam (FIG. 1); in the bracing of a horizontal beam by interconnection to a supporting vertical beam; and in the bracing or support of a horizontal beam or a vertical beam by interconnection to a supporting horizontal beam or a vertical beam, respectively. The beam sections are made in three, six and twelve foot lengths. The adaptor units are sized so that, when attached to the end plates of a single beam section or an extended beam member, the attachment openings of the hypotenuse section thereof will always align with corresponding attachment openings in the vertical and horizontal beam members at the location to place the inclined beam members at substantially a 45° angle relative to both beam members. In this way, multiple inclined beam members each of a different length could be used to interconnect a single pair of horizontal and vertical beam members at a corresponding distance from the juncture of the horizontal and vertical beam members.

In the preferred embodiment, the openings 32 are located at the corners of a six inch square centered on the first side 22 and correspond to the openings 54 of the end plate 46. The openings 34 of the hypotenuse section 26 are spaced on four and one-half inch centers and so four of the openings 34 will align with four of the openings 44 in the leg sections 40 which are located on three inch centers, the transverse spacing between the rows of the openings 34 matching that of the rows of the openings 44.

Although the invention has been described with respect to a preferred embodiment thereof, it is to be understood that it is not to be so limited since changes and modifications can be made therein which are within the full intended scope of the invention as defined in the following claims.

I claim:

1. A method for assembling a brace for maintaining an elongated concrete form assembly in a predetermined supported position by a plurality of beam members, each of which is of a generally rectangular shape in transverse cross section having terminal end plates, comprising:

(a) positioning a first upright beam member laterally from one side of the form assembly;

(b) mounting a second beam member on said first beam member at the end portion thereof adjacent the one side of the form assembly;

(c) inclining a third beam member between said first beam member and said second beam member;

(d) providing a pair of like adaptor units, each of which is of a substantially right isosceles triangular shape in side elevation including a pair of perpendicular side sections and a hypotenuse section;

(e) mounting the hypotenuse section of a first of said adaptor units on the first beam member and the hypotenuse section of a second of said adaptor units on the second beam member with a side section thereof parallel to and facing the corresponding side section of the first of said adaptors a distance apart equal to the length of said inclined beam; and (f) securing the end plates of said inclined beam member to adjacent side section of said adaptor units.

2. The method as defined in claim 1, wherein said inclined beam member is comprised of two or more beam sections attached end-to-end.

3. The method as defined in claim 1, wherein said second adaptor unit is mounted on said second beam member substantially the same distance from said first beam member that said first adaptor unit is mounted on said first beam member above said second beam member.

4. The method as defined in claim 1, wherein:

(a) said first and second beam members have a plurality of longitudinally spaced openings; and (b) said hypotenuse sections have two or more openings for alignment with a corresponding number of said beam member openings.

5. The method as defined in claim 4, further comprising nut and bolt assemblies for releasably securing said adaptor units to said second and first beam members through said aligned openings.

6. The method as defined in claim 1, wherein:

(a) said second beam member and said first beam member have a plurality of longitudinally spaced apart attachment sites for said adaptor units; and (b) for each attachment site on said upright beam for said first adaptor unit there is a corresponding attachment site on said second beam member for said second adaptor such that said corresponding side sections are oppositely facing each other.

7. The method as defined in claim 1, wherein said inclined beam member is positioned at substantially a 45° angle relative to said first beam member and said second beam member.

* * * * *

US004996770B1

REEXAMINATION CERTIFICATE (3182th)

United States Patent [19]

McCracken

[11] B1 4,996,770

[45] Certificate Issued May 6, 1997

[54] METHOD OF ASSEMBLING A CONCRETE FORM BRACE

[75] Inventor: L. Scott McCracken, Des Moines, Iowa

[73] Assignee: Wilian Holding Company, Des Moines, Iowa

Reexamination Request:
No. 90/003,965, Sep. 22, 1995

Reexamination Certificate for:

| | |
|---|---|
| Patent No.: | **4,996,770** |
| Issued: | **Mar. 5, 1991** |
| Appl. No.: | **461,223** |
| Filed: | **Jan. 5, 1990** |

[51] Int. Cl.[6] ..... B23P 17/00

[52] U.S. Cl. ..... 29/897.34; 29/897.3; 29/462; 29/525.02; 249/3; 249/219.1; 248/357

[56] References Cited

U.S. PATENT DOCUMENTS 2,574,274 11/1951 McMullan .
3,710,578 1/1973 Inoue .

OTHER PUBLICATIONS

Symons Brochure, *Versiform Concrete Forming System*, 24 pages (1986).
RMD Brochure, *ErectaBeam*, 6 pages (Nov., 1986).
RMD Brochure, *Multi-Joist*, 6 pages (May, 1981).
EFCO Brochure, *Super Stud System*, 28 pages (Mar., 1991).

*Primary Examiner*—David P. Bryant

[57] ABSTRACT

A method for bracing a concrete form assembly by the interconnection of a first beam member and a second beam member by an inclined beam member. Each beam member is of a generally rectangular shape in transverse cross section and includes a pair of end plates. An adaptor unit of a right isosceles triangular shape in side elevation is used to connect the inclined beam to the first and the second beam. The hypotenuse section of a first adaptor unit is mounted on the first beam and the hypotenuse section of a second adaptor unit is mounted on the second beam. The locations of attachment are selected such that the distance between oppositely facing side sections of the adaptor units is equal to the length of the inclined beam member, which is inserted therebetween. Each end plate of the inclined beam member is bolted to the adjacent side section of an adaptor.

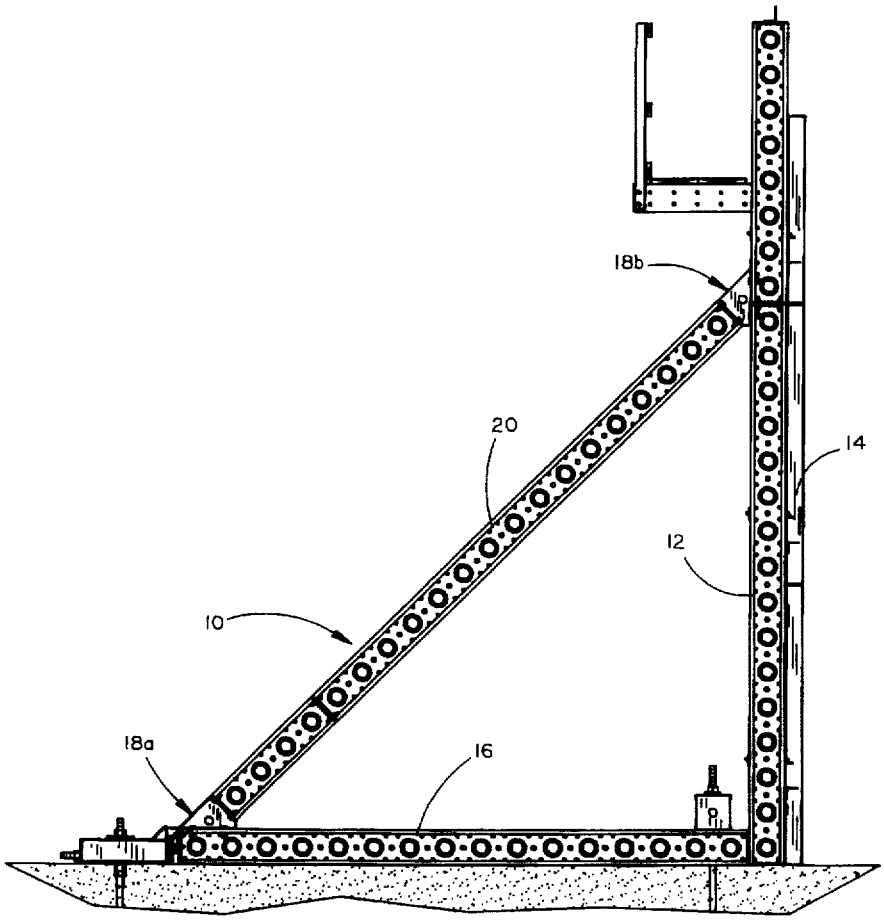

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *